US007043424B2

(12) United States Patent
Chen et al.

(10) Patent No.: US 7,043,424 B2
(45) Date of Patent: May 9, 2006

(54) PITCH MARK DETERMINATION USING A FUNDAMENTAL FREQUENCY BASED ADAPTABLE FILTER

(75) Inventors: Jau-Hung Chen, Hsinchu (TW); Yung-An Kao, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 739 days.

(21) Appl. No.: 10/158,883

(22) Filed: Jun. 3, 2002

(65) Prior Publication Data

US 2003/0125934 A1 Jul. 3, 2003

(30) Foreign Application Priority Data

Dec. 14, 2001 (TW) ..... 90131162 A

(51) Int. Cl.
*G10L 11/04* (2006.01)

(52) U.S. Cl. ..... 704/207; 704/206

(58) Field of Classification Search ..... 704/206–209, 704/211, 213–218, 220, 267–26
See application file for complete search history.

(56) References Cited

U.S. PATENT DOCUMENTS 4,791,671 A * 12/1988 Willems ..... 704/217
4,820,059 A * 4/1989 Miller et al. ..... 704/254
5,220,629 A * 6/1993 Kosaka et al. ..... 704/260
5,349,130 A * 9/1994 Iwaooji ..... 84/616
5,479,564 A * 12/1995 Vogten et al. ..... 704/267
5,596,676 A * 1/1997 Swaminathan et al. ..... 704/208
5,630,011 A * 5/1997 Lim et al. ..... 704/205
5,668,925 A * 9/1997 Rothweiler et al. ..... 704/220
5,809,455 A * 9/1998 Nishiguchi et al. ..... 704/214
5,870,704 A * 2/1999 Laroche ..... 704/209
5,878,388 A * 3/1999 Nishiguchi et al. ..... 704/214
5,963,895 A * 10/1999 Taori et al. ..... 704/207
6,014,617 A * 1/2000 Kawahara ..... 704/207
6,101,463 A * 8/2000 Lee et al. ..... 704/207
6,226,606 B1 * 5/2001 Acero et al. ..... 704/218
6,272,460 B1 * 8/2001 Wu et al. ..... 704/226
6,490,562 B1 * 12/2002 Kamai et al. ..... 704/258
6,587,816 B1 * 7/2003 Chazan et al. ..... 704/207
6,885,986 B1 * 4/2005 Gigi ..... 704/207

OTHER PUBLICATIONS

Gong et al, "Time Domain Harmonic Mathcing Pitch Estimation Using Time-Dependent Speech Modeling", IEEE Transactions on Acoustics, Speech, and Signal Processing. vol. ASSP-35, Oct. 1987, pp. 1386-1400*

Scarr, "Zero Crossing as a Means of Obtaining Spectral Information in Speech Analysis", IEEE Transactions on Audio and Electroacoustics, vol. AU-16, No. 2, 1968, pp. 247-255.*

(Continued)

*Primary Examiner*—Vijay Chawan
*Assistant Examiner*—Michael N. Opsasnick
(74) *Attorney, Agent, or Firm*—Rabin & Berdo, P.C.

(57) ABSTRACT

A method of pitch mark determination for a speech includes the following steps. First, a fundamental frequency and fundamental frequency passband signals are acquired by using an adaptable filter. Then, a number of passing zero positions of the fundamental frequency passband signals are detected. After that, at least a candidate set of pitch marks from a number of passing zero positions are generated. Lastly, the candidate set of pitch marks is estimated to generate the best set of pitch marks.

11 Claims, 6 Drawing Sheets

OTHER PUBLICATIONS

Ohmura et al, "Fine Pitch Extraction by Voice Funadmental Wave Filtering Method", Acoustics, Speech, and Signal Processing, 1994, ICASSP-94., 1994 IEEE International Conference on□ □ vol. ii, Apr. 19-22, 1994 pp. II/189-II/192 vol. 2.*

Ahmadi, S.; Spanias, A.S.; "Cepstrum-based pitch detection using a new statistical V/UV classification algorithm", Speech and Audio Processing, IEEE Transactions on□ □ vol. 7, Issue 3, May 1999 pp. 333-338 □□.*

* cited by examiner

PITCH MARK DETERMINATION USING A FUNDAMENTAL FREQUENCY BASED ADAPTABLE FILTER

This application incorporates by reference of Taiwan application Serial No. 90131162, filed Dec. 14, 2001.

BACKGROUND OF THE INVENTION

1. Field of the Invention

The invention relates in general to a method of pitch mark determination for a speech, and more particularly to a method for detecting a pitch mark of a speech, which is applied to a speech processing system.

2. Description of the Related Art

As speech is the most natural way for human communication and there has been great progress in speech processing over the past few decades, speech has become widely used in the human/machine interface, especially for applying to the information acquisition via telephone, such as the PABX (Private Automatic Branch Exchange) System, the Automated Weather Source System, the Stock Information System, the E-mail Reader System, and so forth. These applications mainly cover fields of speech recognition, speech coding, speaker verification, and speech synthesis.

The speech signals include unvoiced speech and voiced speech. The voiced speech is much more periodic while the unvoiced speech is much more random. In most speech systems, the information of the pitch mark (the start or end point of the pitch period) is first processed by a program automatically and then modified under the control of a hand dial. It is necessary to enhance the program performance for achieving the accuracy of detecting the pitch and pitch mark to decrease the workload of the manual modification. It will be very helpful to the speech synthesis system, which requires establishing new voices quickly or processing a large amount of speech. In addition to the pitch information, the information of the pitch mark is used to analyze the speech characteristics in a period so as to provide help to the promotion of the technology in the speech related fields.

These application fields usually require fundamental frequency or the pitch information. For example, the tone recognition needs to know the pitch contour, the speech coding requires the pitch information, the speaker verification may use fundamental frequency to assist in identity verification, and the speech synthesis of the waveform concatenation requires the pitch information to modify the pitch. Besides, the information of the pitch mark is important to the speech synthesis, and the accuracy of the information of the pitch mark influences the speech quality and the rhythm. As for the speech synthesis and text-to-speech (TTS), the pitch modification requires an accurate pitch mark or pitch-period mark.

It might usually encounter the following two problems while trying to detect the pitch mark: (1) how to acquire the pitch, and (2) how to determine the pitch mark. The acquisition of the pitch can be made by the frequency domain, time domain, or both. Calculating the autocorrelation coefficient is often used. The pitch mark indicates the highest position or the lowest position of the wave in the pitch period. There are several related issued patents as references, which use the following methods: U.S. Pat. No. 5,671,330 searching the local peaks of the dyadic Wavelet conversion as pitch marks, U.S. Pat. No. 5,630,015 performing a cepstrum analysis process to detect a peak of the obtained cepstrum, U.S. Pat. No. 6,226,606 identifying the pitch track according the cross-correlation of two window vectors estimated by the energy of the speech, U.S. Pat. No. 6,199,036 using an auto correlation algorithm to detect the pitch period, U.S. Pat. No. 6,208,958 using spectro-temporal autocorrelation to prevent pitch determination errors, U.S. Pat. No. 6,140,568 filtering out harmonic components to determine which frequencies are fundamental frequencies, U.S. Pat. No. 6,047,254 using order-two Linear Predictive Coding (LPC) and autocorrelation pitch period, U.S. Pat. Nos. 4,561,102 and 4,924,508 finding the peak on the LPC residual, U.S. Pat. No. 5,946,650 using an error function to estimate the low-pass filtering of the speech, U.S. Pat. No. 5,809,453 performing the autocorrelation and cosine transform on the log power spectrum, U.S. Pat. No. 5,781,880 using Discrete Fourier Transform (DFT) to transform the LPC residual, U.S. Pat. No. 5,353,372 introducing Finite Impulse Response (FIR) Filter, U.S. Pat. Nos. 5,321,350 and 4,803,730 finding the point with energy over a predetermined value on the waveform, and U.S. Pat. No. 5,313,553 using two filters.

SUMMARY OF THE INVENTION

It is therefore an object of the invention to provide a method of pitch mark determination for a speech by using an adaptable filter, the passband of which varies with the position of fundamental frequency signal. It prevents the condition that the conventional bandpass filter is constrained in the fixed passband, in which the harmonic frequency signals and the fundamental frequency signals are both retained. Besides, it provides a pitch-mark detector using the position on the waveform to indicate the pitch mark. It increases the accuracy of the pitch marks by finding at least one set of pitch marks at the wave peak and the wave trough of a speech signal and then choosing a best set of pitch marks. The invention can be applied to different sampling frequencies, but some variables in the step of detecting the fundamental frequency signals are modified accordingly. The sampling frequencies according to the embodiment of the invention are 44.1 KHz and 22.05 KHz; other sampling frequencies can be modified appropriately.

The invention achieves the above-identified objects by providing a method of pitch mark determination for a speech. The procedures includes: acquiring a fundamental frequency point and a fundamental frequency passband signal by using an adaptable filter; detecting a number of passing zero positions of the fundamental frequency passband signal; and generating at least a set of pitch marks from a number of passing zero positions. Moreover, estimating several sets of pitch marks generates the best set of pitch marks.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
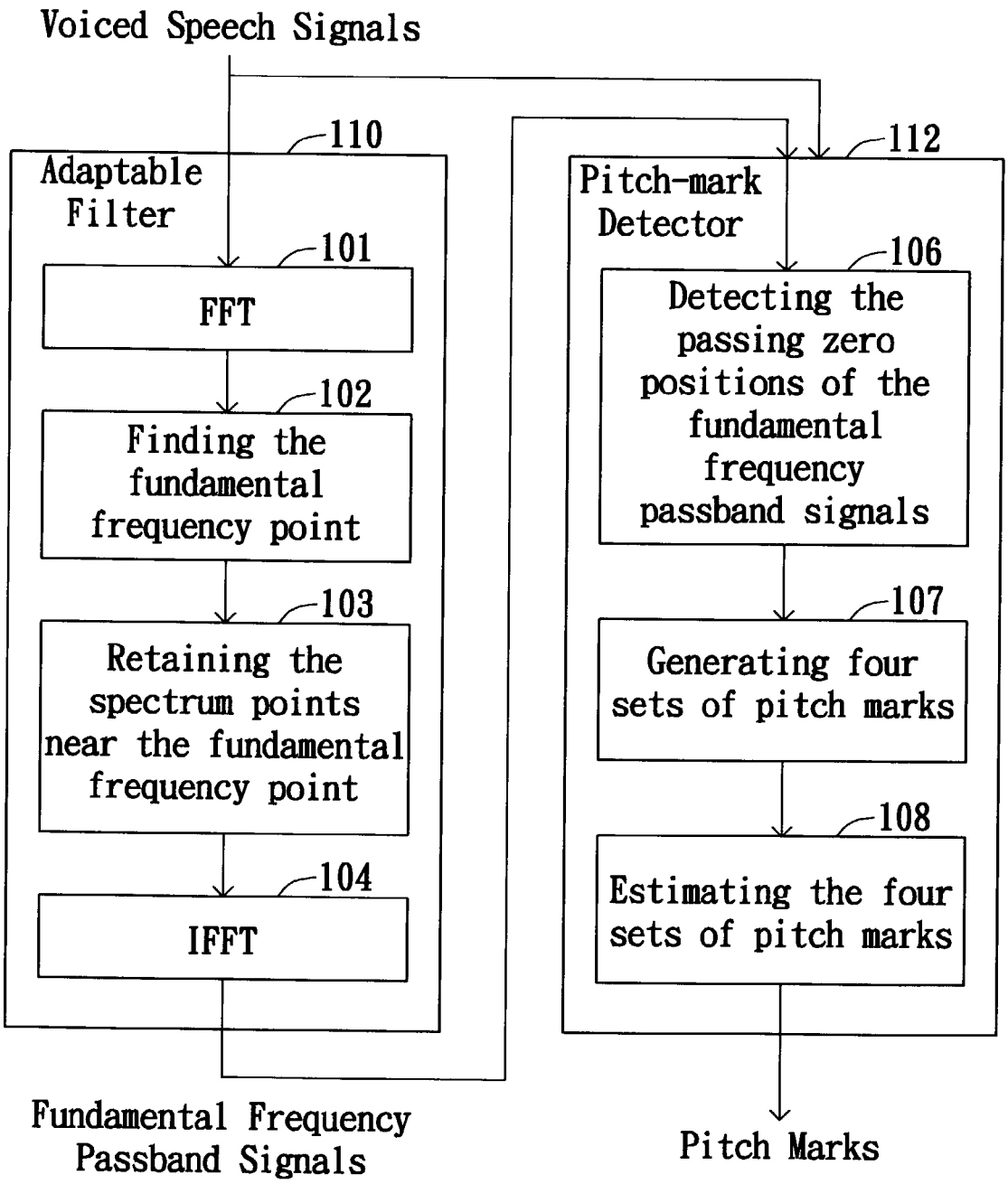
FIG. 1 illustrates the structure of a method of pitch mark determination for a speech according to the invention.

Referring to FIG. 1, the structure of a method of pitch mark determination for a speech according to the invention is illustrated. There are two parts of the structure in FIG. 1. The first part is concerning the adaptable filter 110, which is used for filtering out the signals other than the fundamental frequency of the periodic voiced speech signals, a vowel for example. The procedures are as follows: In step 101, a number of speech signals of the speech in a widow is captured and transformed into the spectrum by a transform function. In step 102, a fundamental frequency point is then found on the spectrum. In step 103, the spectrum points near the fundamental frequency point are retained. In step 104, fundamental passband frequency signals are found by performing an inverse transform function. The transform function can be the Fast Fourier Transform (FFT) while the inverse function can be the Inverse Fast Fourier Transform (IFFT).

Besides, the method for detecting the fundamental frequency is developed by using that the fundamental frequency and the harmonic frequency have larger spectrum responses in the spectrum. The second part in FIG. 1 is concerning a pitch-mark detector 112, which detects a set of pitch marks of a speech by the following procedures: step 106: detecting a number of passing zero positions of the fundamental frequency passband signals; step 107: generating four sets of pitch marks from those passing zero positions; and step 108: estimating the four sets of pitch marks to generate the required set of pitch marks. The pitch-mark detector 112 analyzes the passing zero points of the fundamental frequency passband signals from the adaptable filter 110 and obtains the period accordingly. In the period of the speech signals, two sets of pitch marks are found on the wave peak and two sets of pitch marks are found on the wave trough. Subsequently, the best set of pitch marks is generated after estimation.

Figure 2:
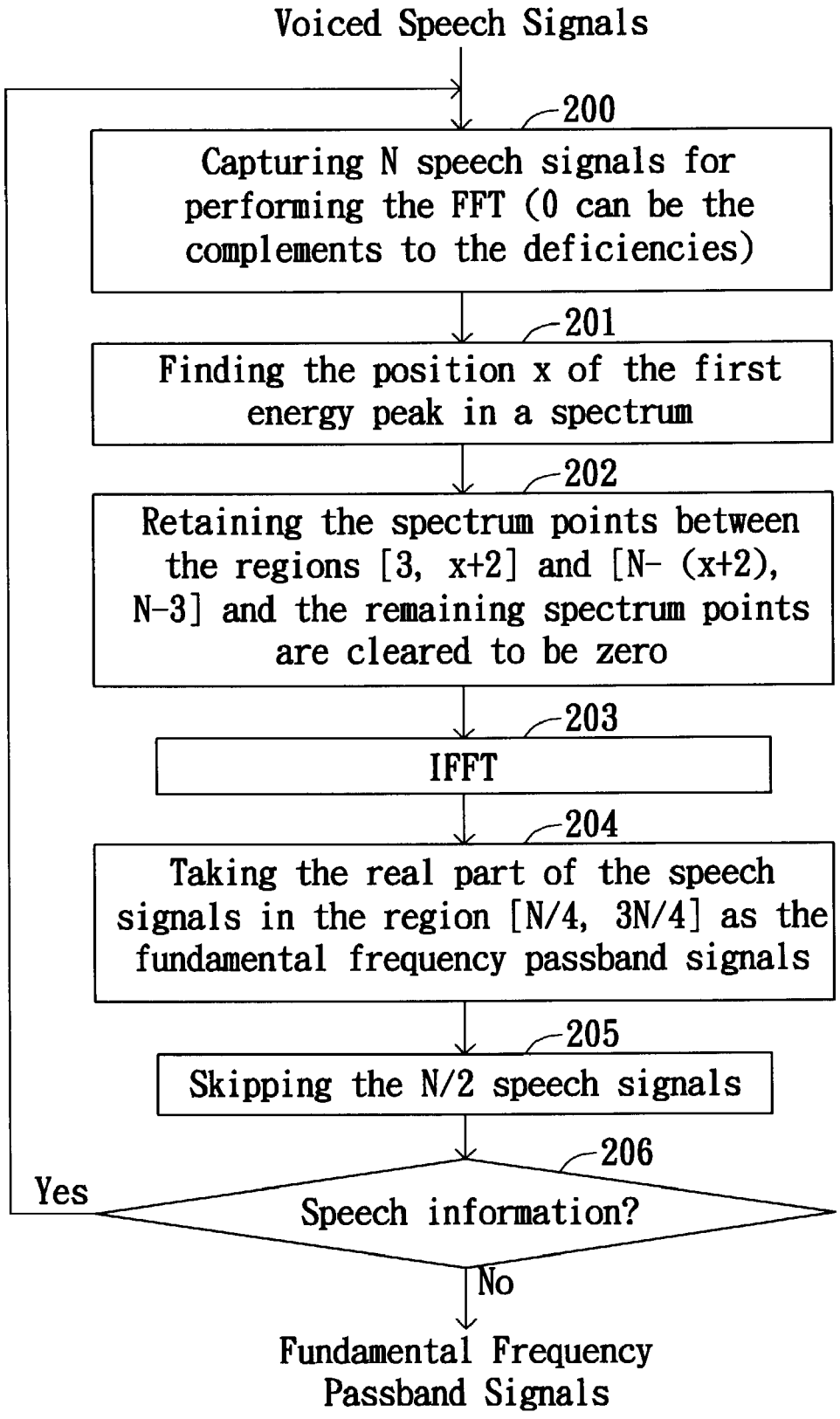
FIG. 2 is a flowchart showing the mathematical calculation of the adaptable filter according to the preferred embodiment of the invention.

Referring to FIG. 2, the flowchart shows the mathematical calculation of the adaptable filter according to the preferred embodiment of the invention, which corresponds to the first part of FIG. 1. In step 200, N speech signals are captured for performing the FFT (0 can be the complements to the deficiencies). In step 201, the position x of the first energy peak is found in a spectrum. In step 202, the spectrum points between the region [3, x+2] and the region [N−(x+2), N−3] are retained and the remaining spectrum points are cleared to be zero. In step 203, the IFFT is performed. In step 204, the real part of the speech signals in the region [N/4, 3N/4] is taken as the fundamental frequency passband signals. In step 205, the N/2 speech signals are skipped. In step 206, if there exists speech information, it returns back to step 200; if not, the fundamental frequency passband signals are outputted. The variable x varies with the sampling frequency while the ratio of the sampling frequency and the length of the window can be chosen as a constant as required. For example, the length of the window can be chosen as 4096 (N=4096) when the sampling frequency is 44.1 KHz, and the length of the window can be chosen as 2048 (N=2048) when the sampling frequency is 22.05 KHz.

Figure 3:
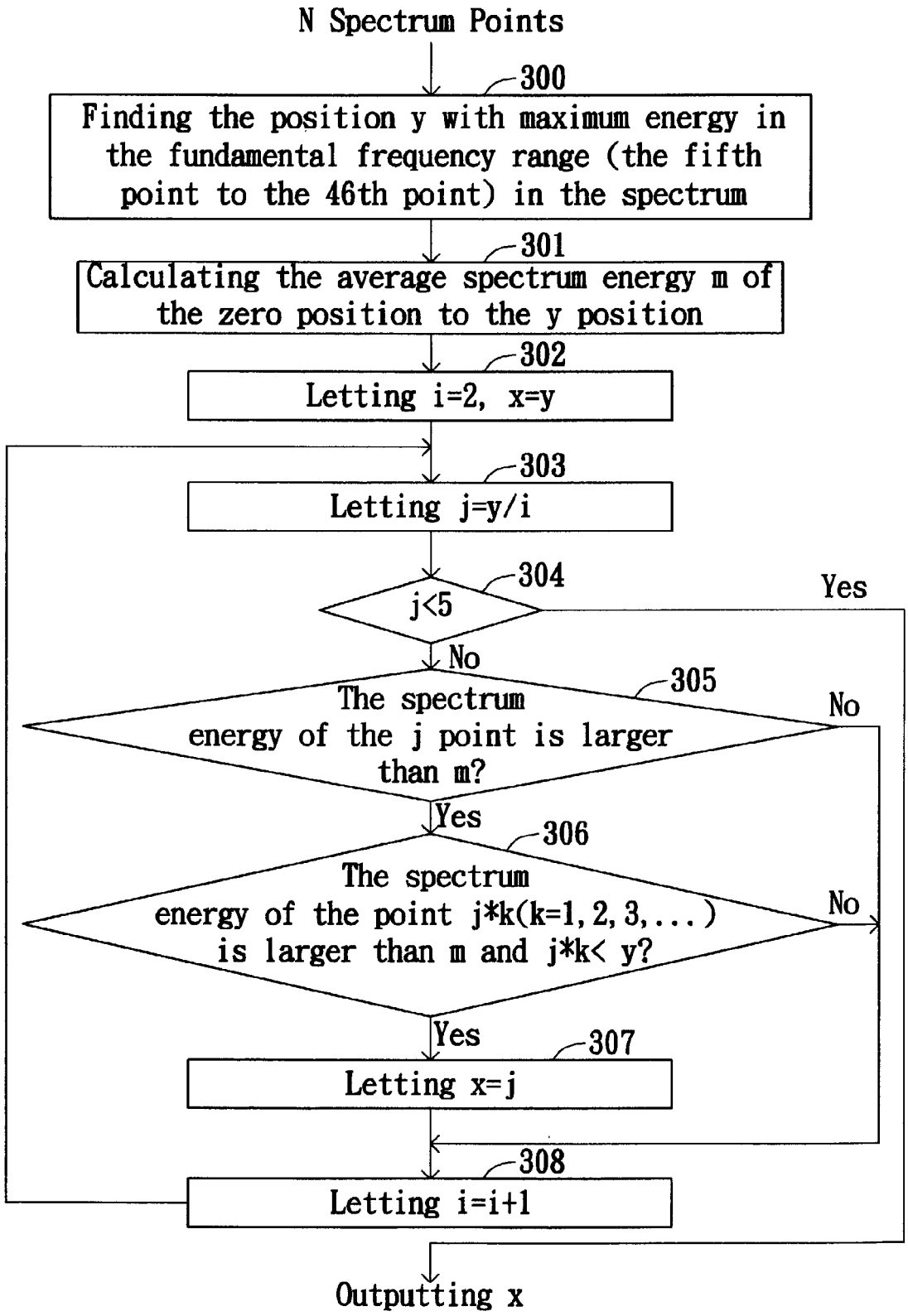
FIG. 3 is a flowchart showing the implementation of finding the position x of the first energy peak in the spectrum.

Referring to FIG. 3, the implementation of finding the position x of the first energy peak in the spectrum is shown. The flowchart illustrates the detailed procedures of step 201 in FIG. 2. In step 300, since the fundamental frequency of human speech is about 50 Hz~500 Hz, the position y with maximum energy is found in a corresponding fundamental frequency range (the fifth point to the $46^{th}$ point for example) at different sampling frequencies and the corresponding chosen length of the window in the spectrum. In step 301, the average spectrum energy m of the zero position to the y position is calculated. In step 302, y is assumed to be i times the fundamental frequency and i is let to be 2 (i=2). Besides, x is let to be y (x=y, x represents the possible fundamental frequency). In step 303, the possible fundamental frequency is found and j is let to be y/i (j=y/i). In step 304, the determination of going beyond the range is made and the x is outputted if j<5. In step 305, the determination of the harmonic frequency is made and step 308 is entered if the spectrum energy of the j point is no larger than m. In step 306, the determination of the harmonic frequency point is made and the x is let to be j (x=j) if the spectrum energy of the harmonic frequency point j*k (k=1, 2, 3, . . . ) is larger than m and j*k<y. In step 307, the possible fundamental frequency point is found and x is let to be j. In step 308, the i+1 times the fundamental frequency is considered and i is incremented to be i+1. The procedure returns back to step 303.

Figure 4:
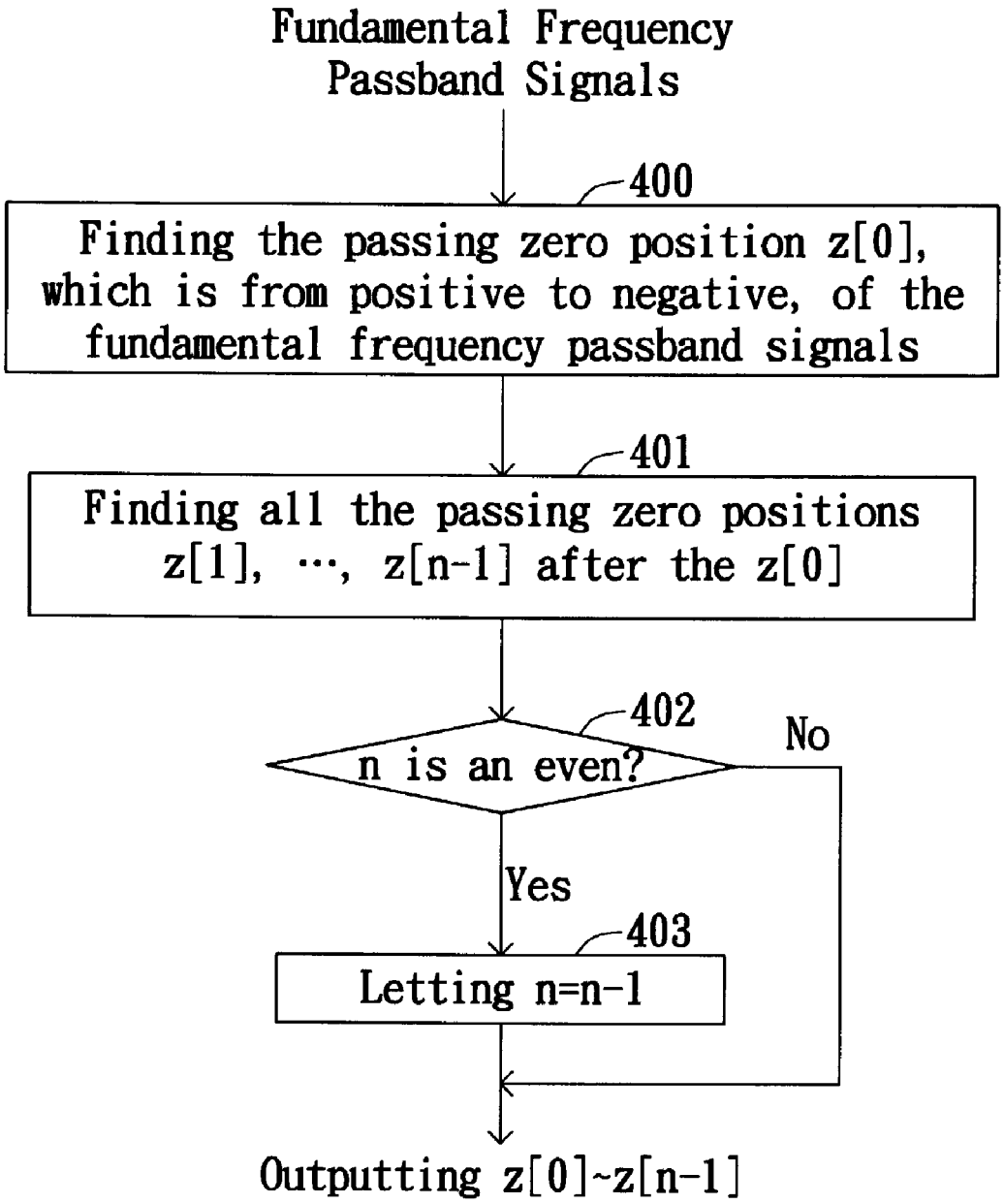
FIG. 4 is a flowchart showing the implementation of detecting the passing zero position of the fundamental frequency passband signal.

Referring to FIG. 4, the flowchart shows the implementation of detecting the passing zero position of the fundamental frequency passband signals for the further explanation of step 106 in FIG. 1. In step 400, the passing zero position z[0], which is from positive to negative, of the fundamental frequency passband signals are found. In step 401, all the passing zero positions z[1], . . . , z[n−1] after the z[0] are found. In step 402, if n is an even number, then step 403 is performed; if not, z[1], . . . , z[n−1] are outputted.

Figure 5:
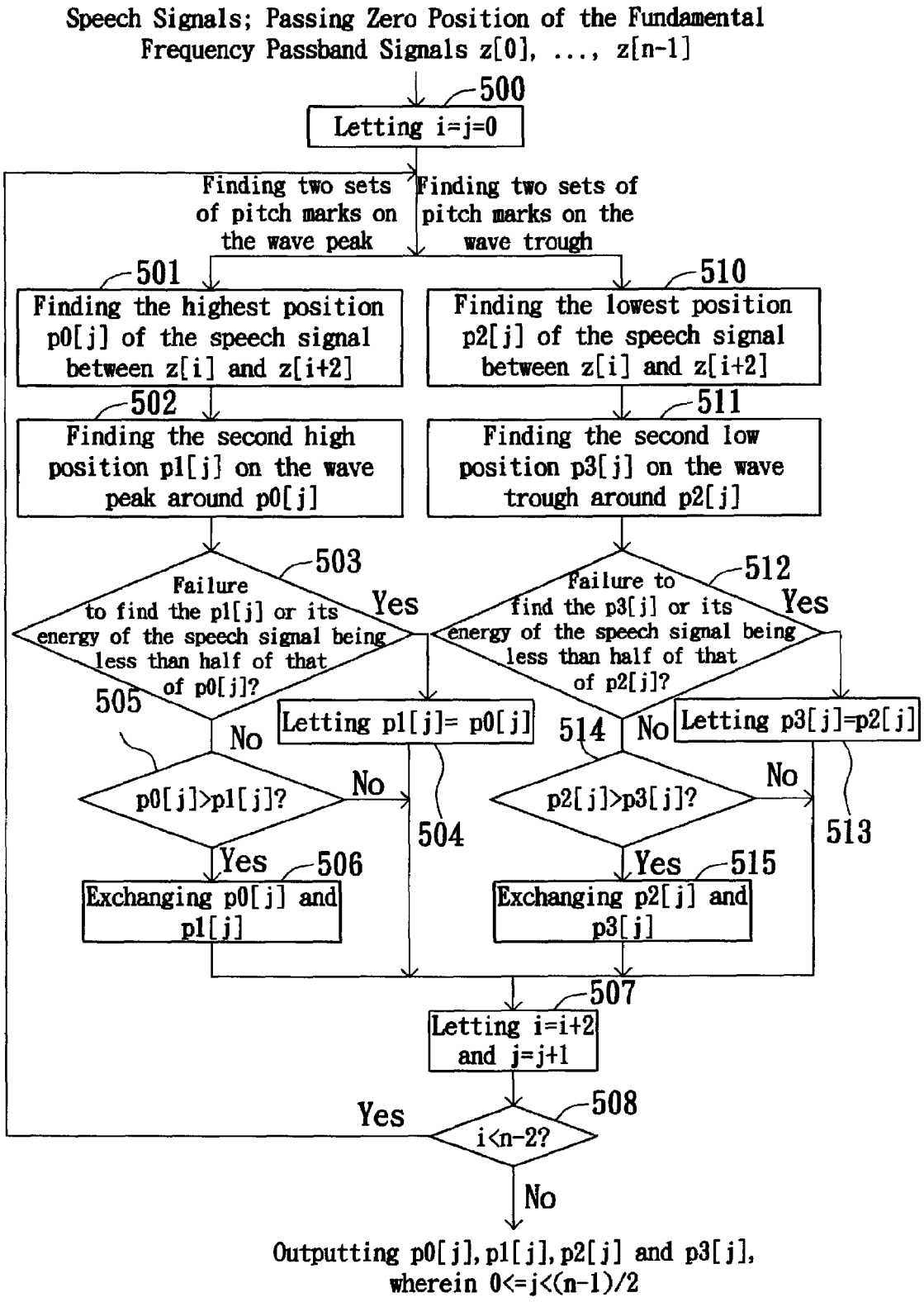
FIG. 5 shows a flowchart of the method for finding a pitch mark of a speech according to the preferred embodiment of the invention.

Referring to FIG. 5, the method for finding a pitch mark of a speech according to the preferred embodiment of the invention is shown. The flowchart in FIG. 5 is for further explanation about step 107 in FIG. 1. In step 500, j and i are both let to be 0 (i=j=0). In order to find two sets of pitch marks on the wave peak, the highest position p0[j] of the speech signal is first found between z[i] and z[i+2] in step 501 and the second high position p1[j] is found on the wave peak around p0[j] in step 502. In step 503, if the p1[j] is not found or its energy of the speech signal is less than half of that of p0[j], then p1[j] is let to be equal to p0[j](p1[j]=p0[j]) in step 504 and step 507 is entered; otherwise, step 505 is performed. In step 505, if p0[j]>p1[j], step 506 is entered and p0[j] and p1[j] are exchanged; otherwise, step 507 is performed. In step 507, i is incremented by 2 (i=i+2) and j is incremented by 1 (j=j+1). In step 508, if i<n−2, then step 501 and 510 are entered; if not, p0[j], p1[j], p2[j], and p3[j] are outputted, wherein 0<=j<(n−1)/2. On the other hand, in order to find two sets of pitch marks on the wave trough, the lowest position p2[j] of the speech signal is first found between z[i] and z[i+2] in step 510 and the second low position p3[j] is found on the wave trough around p2[j] in step 511. In step 512, if the p3[j] is not found or its energy of the speech signal is less than half of that of p2[j], then p3[j] is let to be equal to p2[j](p3[j]=p2[j]) in step 513 and step 507 in entered; otherwise, step 514 is performed. In step 514, if p2[j]>p3[j], step 515 is entered and p2[j] and p3[j] are exchanged; otherwise, step 507 performed.

Figure 6:
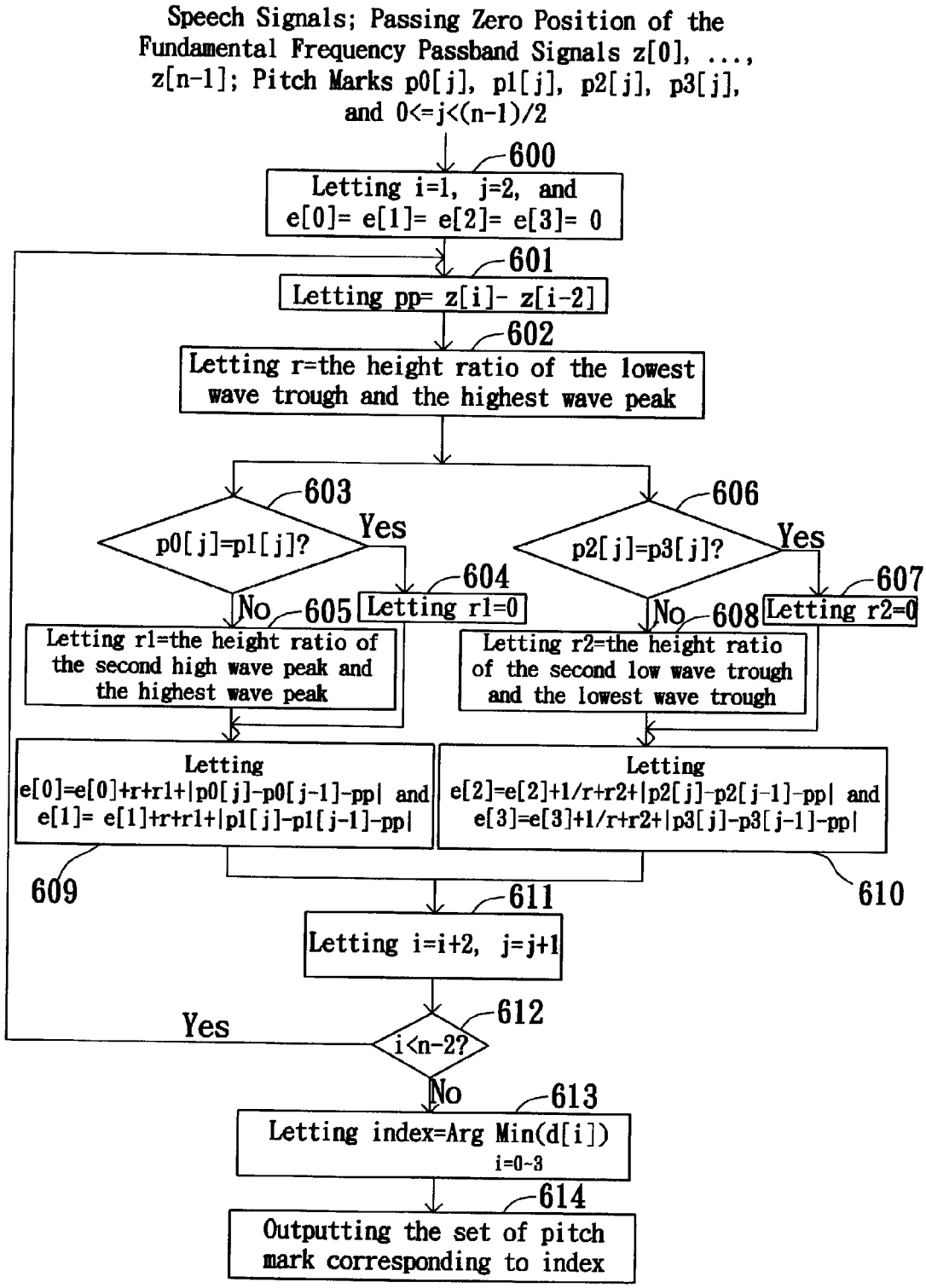
FIG. 6 shows a flowchart of the method of pitch mark estimation for a speech according to the preferred embodiment of the invention.

Referring to FIG. 6, a flowchart of the method of pitch mark estimation for a speech according to the preferred embodiment of the invention is shown, which is for further explanation about step 107 in FIG. 1. In step 600, i is let to be 2 and j is let to be 1 (i=1, j=2), and e[0], e[1], e[2], and e[3] are all let to be 0 (e[0]=e[1]=e[2]=e[3]=0), wherein e[0]~e[3] represents the aggregate errors of sets of the pitch marks. In step 601, the predicted period pp is assumed to be z[i]−z[i−2](pp=z[i]−z[i−2]). In step 602, r is let to be the amplitude ratio of the lowest wave trough and the highest wave peak of the speech signal and step 603 or step 606 is entered.

In step 603, if p0[j]=p1[j], then step 604 is performed and r1 is let to be 0 (r1=0); otherwise, step 605 is performed and r1 is let to be the amplitude ratio of the second high wave peak and the highest wave peak of the speech signal.

In step 606, if p2[j]=p3[j], then step 607 is performed and r2 is let to be 0 (r2=0); otherwise, step 608 is performed and r2 is let to be the amplitude ratio of the second low wave trough and the lowest wave trough of the speech signal.

After step 605 or 604, step 609 is performed. In step 609, e[0] is let to be e[0]+r+r1+|p0[j]−p0[j−1]−pp| and e[1] is let to be e[1]+r+r1+|p1[j]−p1[j−1]−pp|, wherein |p0[j]−p0[j−1]−pp| and |p1[j]−p1[j−1]−pp| represents the error of the wave-peak period (that is the distance between two wave peaks of the pitch marks) and the predicted period (that is the distance between a passing zero point and a passing zero point after the next passing zero point). After step 607 or 608, step 610 is performed. In step 610, e[2] is let to be e[2]+1/r+r2+|p2[j]−p2[j−1]−pp| and e[e] is let to be e[3]+1/r+r2+|p3[j]−p3[j−1]−pp|, wherein |p2[j]−p2[j−1]−pp| and |p3[j]−p3[j−1]−pp| represents the error of the wave-trough period (that is the distance between two wave troughs of the pitch marks) and the predicted period. After step 609 or 610, step 611 is performed that i is incremented by 2 (i=i+2) and j is incremented by 1 (j=j+1). In step 612, if i<n−2, then it returns to step 601; if not, step 613 is entered and the set of pitch mark with a smallest aggregate error is found and the equation is hold:

$$\text{index} = \underset{i=0\sim3}{\text{ArgMin}}(d[i]).$$

In step 614, the set of pitch mark corresponding to index is outputted.

The method of pitch mark determination for a speech according to the invention uses the property that the fundamental frequency and the harmonic frequency have larger spectrum responses in the spectrum to develop a method for detecting the fundamental frequency, using an adaptable filter, the passband of which varies with the position of fundamental frequency signal. It prevents the condition that the conventional bandpass filter is constrained in the fixed passband area, in which the harmonic frequency signals and the fundamental frequency signals are both retained. Besides, the pitch-mark detector analyzes the passing zero points of the fundamental frequency passband signals from the adaptable filter and obtains the period accordingly. In the period of the speech signals, two sets of pitch marks are found on the wave peak and two sets of pitch marks are found on the wave trough. Subsequently, the best set of pitch marks is generated after estimation and therefore increases the accuracy of choosing the best pitch mark.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of pitch mark determination for a speech signal, the method comprising the steps of:

acquiring a fundamental frequency and a plurality of fundamental frequency passband signals by using an adaptable filter;

detecting a plurality of passing zero positions of the fundamental frequency passband signals;

generating at least a candidate set of pitch marks from a plurality of passing zero positions, the generating step including:

finding a highest position and a second highest position of the speech signals, using the passing zero positions, and finding a lowest position and a second lowest position of the speech signals, using the passing zero positions; and estimating the candidate set of pitch marks to generate a set of pitch marks by respectively calculating an aggregate error of each set of pitch marks, and then generating a corresponding set of pitch marks with a smallest aggregate error;

wherein calculating the aggregate error is by separately calculating an aggregate error of the wave peak of the speech signals and an aggregate error of the wave trough of the speech signals.

2. The method according to claim 1, wherein the aggregate error of the wave peak is a sum of the following in each predicted period: an amplitude ratio of the lowest wave trough and the highest wave peak of the speech signals, an amplitude ratio of the second highest wave peak and the highest wave peak of the speech signals, and an error between a wave-peak period and the predicted period.

3. The method according to claim 2, wherein the wave-peak period is the distance between two wave-peak pitch marks.

4. The method according to claim 2, wherein the predicted period is the distance between a passing zero point and a passing zero point after the next passing zero point.

5. The method according to claim 1, wherein the aggregate error of the wave trough is a sum of the following in each predicted period: an amplitude ratio of the highest wave peak and the lowest wave trough of the speech signals, an amplitude ratio of the second lowest wave trough and the lowest wave trough of the speech signals, and an error between a wave-trough period and the predicted period.

6. The method according to claim 5, wherein the predicted period is the distance between a passing zero point and a passing zero point after the next passing zero point.

7. The method according to claim 5, wherein the wave-trough period is the distance between two wave-trough pitch marks.

8. The method according to claim 1, wherein the step of acquiring the fundamental frequency and the fundamental frequency passband signals by using the adaptable filter further comprises the following steps:

capturing a plurality of speech signals of the speech and generating a first function;

finding the fundamental frequency by performing a transform function on the first function;

retaining a plurality of spectrum points near a fundamental frequency point and generating a second function; and finding fundamental passband frequency signals by performing an inverse transform function on the second function.

9. The method according to claim 8, wherein the spectrum points near the fundamental frequency point lie between the range [3, the fundamental frequency point+2] and the range [N−(the fundamental frequency point+2), N−3], which corresponds to the first function after transformation, while the number of the speech signals is N.

10. The method according to claim 9, wherein the fundamental frequency point is a position with maximum energy found in a corresponding fundamental frequency range.

11. The method according to claim 9, wherein the fundamental frequency passband signals are the real part of the speech signals in the range [N/4, 3N/4] except the N/2 speech signals.

* * * * *